US009470194B2

(12) United States Patent
Gebhardt et al.

(10) Patent No.: US 9,470,194 B2
(45) Date of Patent: Oct. 18, 2016

(54) INJECTOR FOR INJECTING FUEL INTO AN INTERNAL COMBUSTION ENGINE

(71) Applicant: Continental Automotive GmbH, Hannover (DE)

(72) Inventors: Xaver Gebhardt, Regensburg (DE); Anatoliy Lyubar, Wolfsegg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 14/424,566

(22) PCT Filed: Aug. 19, 2013

(86) PCT No.: PCT/EP2013/067240

§ 371 (c)(1),
(2) Date: Feb. 27, 2015

(87) PCT Pub. No.: WO2014/033002

PCT Pub. Date: Mar. 6, 2014

(65) Prior Publication Data

US 2015/0260137 A1 Sep. 17, 2015

(30) Foreign Application Priority Data

Aug. 31, 2012 (DE) ..... 10 2012 215 448

(51) Int. Cl.
*F02M 51/00* (2006.01)
*F02M 51/06* (2006.01)
(Continued)

(52) U.S. Cl.
CPC ..... *F02M 51/0625* (2013.01); *F01L 9/02* (2013.01); *F02M 51/061* (2013.01); *F02M 51/066* (2013.01); *F02M 51/0685* (2013.01); *F02M 63/0022* (2013.01); *F02M 2200/304* (2013.01)

(58) Field of Classification Search
CPC ..... F02M 51/0625; F02M 51/066; F02M 51/0685; F02M 63/0022; F02M 2200/304; F02M 51/061; F01L 9/02
USPC ..... 239/585.1–585.5; 251/48
See application file for complete search history.

(56) References Cited

U.S. PATENT DOCUMENTS 4,984,549 A * 1/1991 Mesenich ..... F02M 51/0625 239/585.5
6,279,873 B1 8/2001 Eichendorf et al. ..... 251/129.19
(Continued)

FOREIGN PATENT DOCUMENTS

DE 19816315 A1 10/1999 ..... F02M 51/06
DE 19948238 A1 4/2001 ..... F02M 51/06
(Continued)

OTHER PUBLICATIONS

International Search Report and Written Opinion, Application No. PCT/EP2013/067240, 13 pages, Oct. 30, 2013.

*Primary Examiner* — Steven J Ganey
(74) *Attorney, Agent, or Firm* — Slayden Grubert Beard PLLC

(57) ABSTRACT

An injector for injecting fuel into an internal combustion engine includes a drive unit accommodated in a housing and which has an armature guided in sliding manner in the housing, and includes a valve element that is axially movable in the armature relative to the armature. The valve element has a driver element for a coupling to the armature and can be moved in order to open and/or close at least one injection opening, wherein the opening movement is limited by an abutment surface. A flange-like abutment member is fixedly connected to the valve element, and is designed such that, during the opening of the at least one injection opening, a first hydraulic damping layer is formed between said abutment member and the abutment surface, and during the closing of the at least one injection opening, a second hydraulic damping layer is formed between said abutment member and the armature.

16 Claims, 2 Drawing Sheets

(51) Int. Cl.
*F01L 9/02* (2006.01)
*F02M 63/00* (2006.01)

(56) References Cited

U.S. PATENT DOCUMENTS

| | | | | |
|---|---|---|---|---|
| 6,510,841 | B1 | 1/2003 | Stier | 123/472 |
| 6,796,543 | B2 | 9/2004 | Haeberer et al. | 251/50 |
| 7,086,614 | B2 | 8/2006 | Stier et al. | 239/585.2 |
| 7,354,027 | B2 * | 4/2008 | Mennicken | F02M 51/0635 239/585.3 |
| 2006/0163390 | A1 | 7/2006 | Ruehle et al. | 239/585.1 |
| 2011/0278368 | A1 | 11/2011 | Hornby | 239/5 |

FOREIGN PATENT DOCUMENTS

| | | | | |
|---|---|---|---|---|
| DE | 10039083 | A1 | 2/2002 | F02M 51/06 |
| DE | 10113008 | A1 | 5/2002 | F02M 47/02 |
| DE | 10305985 | A1 | 7/2004 | F02M 51/06 |
| DE | 102007060396 | A1 | 6/2009 | F02M 47/02 |
| DE | 102008000695 | A1 | 9/2009 | F02M 61/20 |
| EP | 2249022 | A1 | 11/2010 | F02M 51/06 |
| EP | 2444651 | A1 | 4/2012 | F02M 51/06 |
| WO | 2004/051073 | A1 | 6/2004 | F02M 51/06 |
| WO | 2014/033002 | A1 | 3/2014 | F02M 51/06 |

* cited by examiner

INJECTOR FOR INJECTING FUEL INTO AN INTERNAL COMBUSTION ENGINE

CROSS-REFERENCE TO RELATED APPLICATIONS

This application is a U.S. National Stage Application of International Application No. PCT/EP2013/067240 filed Aug. 19, 2013, which designates the United States of America, and claims priority to DE Application No. 10 2012 215 448.5 filed Aug. 31, 2012, the contents of which are hereby incorporated by reference in their entirety.

TECHNICAL FIELD

The invention relates to an injector for injecting fuel into an internal combustion engine.

BACKGROUND

For the supply of fuel to combustion chambers of internal combustion engines, use is preferably made of lift-controlled injectors such as, for example, electromagnetically operated injectors. Normally, such injectors have an electronic controller by means of which, for example, an injection duration, an injection amount and/or a multiple injection can be set. With regard to future prescribed limits for pollutant emissions, controllers of said type should increase combustion efficiency and reduce fuel consumption. In the case of conventional injectors, use is generally made of an actuator which performs a lifting movement for the purposes of opening and closing an injection opening. In particular in the case of electromagnetically operated injectors, such lifting movements of the actuator, that is to say an actuation of an armature, which is coupled to a valve needle, by means of a magnetic field, are restricted during the opening and closing movements by a respective abutment, wherein bouncing against the abutments may occur. Here, in particular in the case of injectors in which the valve needle and the armature are not rigidly connected to one another, an overshooting or over travel of the valve needle may occur, such that a flow rate of the fuel during the injection process is impaired. This is manifested in a so-called S-shaped curve in the fuel flow rate, that is to say in a non-linearity in the flow rate characteristic curve of the injector during the injection process, whereby the efficiency of the combustion is reduced.

A further problem is the bouncing of the armature during the closing of the injector, wherein, when the valve needle reaches the valve seat during the closing process, the armature performs a downward follow-through oscillation and, as it returns into its rest position, the valve needle briefly lifts from its valve seat, which can result in undesired post-injections. The additional fuel supplied by the post-injection may be incompletely burned, whereby the pollutant emissions are increased. In addition, over the long term, fuel consumption is increased. Furthermore, owing to the bounce in the current signal, no clear signal for valve seat detection can be identified.

DE 10 2007 060 396 A1 discloses an injector with a needle which is connected via an elastic web to an armature in order that, via the elastic web, equal and opposite vibration movement between the armature and the needle is made possible. Said equal and opposite vibration movement is intended to reduce the overall bounce during the closing process. The construction of an injector of said type is however relatively complex and is furthermore afflicted with the problem of fatigue of the elastic components, which can result in high maintenance outlay.

SUMMARY

One embodiment provides an injector for injecting fuel into an internal combustion engine, comprising a drive unit which is accommodated in a housing and which has an armature guided in sliding fashion in the housing, and comprising a valve element which is movable in the armature axially with respect thereto and which has a driver element for coupling to the armature and which is movable for the purpose of opening and/or closing at least one injection opening, wherein the opening movement is limited by an abutment surface, wherein a flange-like abutment element is fixedly connected to the valve element, wherein the flange-like abutment element is designed such that, during the opening of the at least one injection opening, a first hydraulic damping layer is formed between said abutment element and the abutment surface, and during the closing of the at least one injection opening, a second hydraulic damping layer is formed between said abutment element and the armature.

In a further embodiment, the flange-like abutment element is connected to the driver element.

In a further embodiment, the flange-like abutment element has a surface which covers the abutment surface and/or the first surface of the armature at least in regions.

In a further embodiment, the flange-like abutment element is formed from a magnetic material.

In a further embodiment, the drive unit is in the form of a solenoid drive.

In a further embodiment, the armature and the valve element are movable, during the opening movement, counter to the force of at least one first spring and, during the closing movement, counter to the force of at least one second spring.

In a further embodiment, the valve element is a valve needle, preferably a hollow needle.

BRIEF DESCRIPTION OF THE DRAWINGS

Example embodiments are discussed below with reference to the drawings, in which.

DETAILED DESCRIPTION

Figure 1:
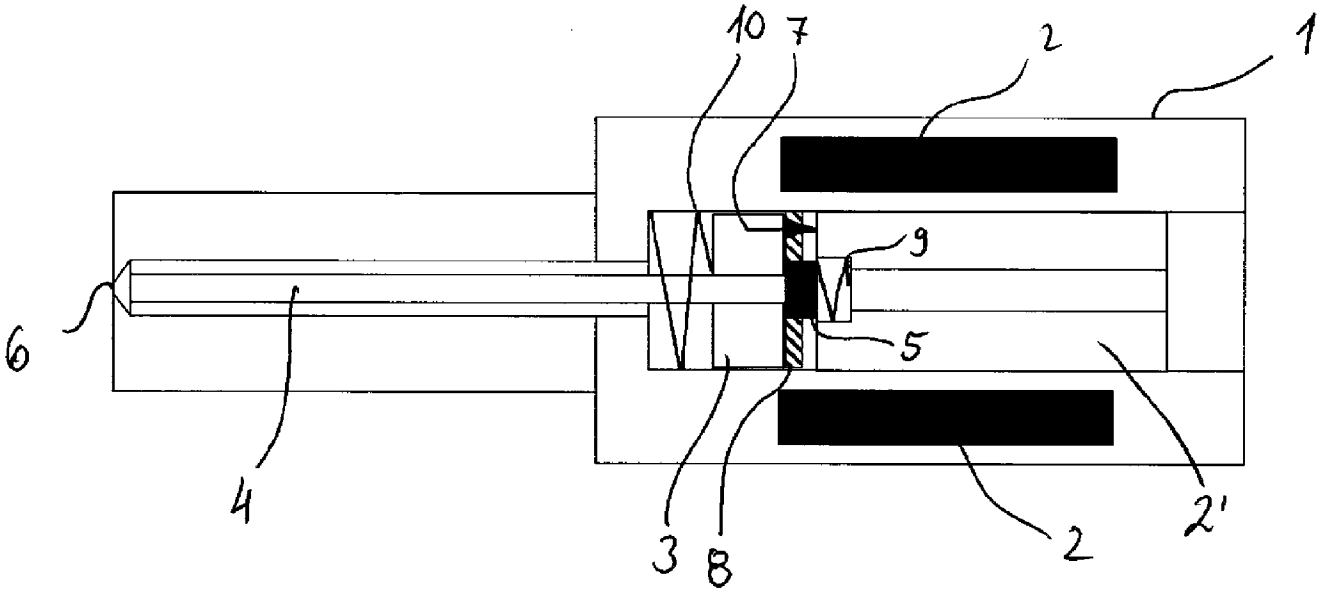
FIG. 1 is a schematic sectional illustration of an injector for injecting fuel into an internal combustion engine, according to one exemplary embodiment of the invention.

Embodiments of the present invention provide an injector for injecting fuel into an internal combustion engine, in the case of which injector bounce during the opening and closing process, and thus undesired post-injections, can be prevented, and the efficiency of the fuel injection is improved.

In one embodiment, an injector for injecting fuel into an internal combustion engine comprises a drive unit which is accommodated in a housing and which has an armature guided in sliding fashion in the housing, and comprising a valve element which is movable in the armature axially with respect thereto and which has a driver element for coupling to the armature and which is movable for the purpose of opening and/or closing at least one injection opening, wherein the opening movement is limited by a first abutment surface. Furthermore, the injector comprises a flange-like abutment element which is fixedly connected to the valve element, wherein the flange-like abutment element is designed such that, during the opening of the at least one injection opening, a first hydraulic damping layer is formed between said abutment element and the abutment surface, and during the closing of the at least one injection opening, a second hydraulic damping layer is formed between said abutment element and a first surface of the armature.

The flange-like abutment element, which may preferably be connected to the driver element of the valve element, constitutes an abutment of the valve element in relation to the abutment surface.

During the opening of the valve element, a displacement of the medium, for example gasoline or diesel, out of the intermediate space between the abutment surface and the flange-like abutment element opposes the drive force of the drive unit. Owing to the slow displacement of the medium out of the intermediate space, it is possible for the first hydraulic damping layer, which decreases in thickness, to form between the flange-like abutment element and the abutment surface, which first hydraulic damping layer dampens the lifting movement directed toward the abutment surface. In this case, the first hydraulic damping layer substantially prevents contact between the flange-like abutment element and the abutment surface. In this way, bouncing of the valve element against the abutment during the opening of the injector can be prevented, thus ensuring a linear characteristic curve profile of the injection amount of the fuel.

During the closing of the injector, that is to say during a movement of the armature into its rest position, the valve element moves into the valve seat, whereas the armature moves away from the flange-like abutment element and overshoots downward, because it is not rigidly connected to the valve needle. In this case, adhesion forces may arise between the flange-like abutment element and the armature, which adhesion forces significantly hinder a detachment of the armature from the flange-like abutment element, such that the downward overshoot movement of the armature is intensely braked or dampened.

During the detachment, there is formed between the flange-like abutment element and the armature a medium-filled intermediate space which is at its largest at a reversal point of the downward overshoot movement of the armature. In this case, the force of the return oscillation movement of the armature into the rest position acts against the flange-like abutment element such that the medium is displaced out of the intermediate space and the second hydraulic damping layer forms.

Owing to the displacement of the medium, the bouncing of the armature can be dampened to such an extent that the valve element is not lifted from the valve seat. In this case, the second hydraulic damping layer prevents contact between the armature and the flange-like abutment element. Consequently, post-injections caused by the bouncing can be prevented, whereby pollutant emissions are lowered and fuel is saved. Since the downward overshoot movement of the armature during the closing process is braked to an extreme degree, a clear current signal in the form of a sharp bend can be registered for valve seat detection.

The flange-like abutment element should preferably have a surface which covers the abutment surface and/or the first surface of the armature at least in regions. Since the size of the surface has a significant effect on the damping action, it may be advantageous for the surface of the flange-like abutment element to fully cover the abutment surface and/or the surface of the armature. Accordingly, the flange-like abutment element may be in the form of an axially symmetrical circular disc which has, for example, a diameter of 7 mm and a thickness of 1.5 mm.

The flange-like abutment element and in particular the surface thereof is preferably of complementary form, in sections or in its entirety, with respect to the abutment surface or surface of the armature. This relates preferably at least to that surface of the abutment element which covers the abutment surface and/or the surface of the armature. The surface of the abutment element is for example flat, and is in particular circular.

To form the first and second damping layers, a contact surface between the flange-like abutment element and the abutment surface or the armature should be kept as small as possible.

The flange-like abutment element may preferably be manufactured from a magnetic material in order to increase the magnetic force between it and the armature. In this way, an improved COSI (Controlled Solenoid Injection) signal can be generated, which is conducive to improved control of an injected amount of fuel.

Furthermore, the injector may have at least one first and one second spring, counter to which the armature and the valve element and the flange-like abutment element connected thereto are movable during the opening and closing movements. The springs are dimensioned such that a smooth opening and closing movement of the valve element is ensured.

In one embodiment, a so-called hydrodisc in the form of a rotationally symmetrical disc is provided between the armature and the second spring. During the closing of the injector, the hydrodisc prevents an excessive downward overshoot of the armature through the formation of a further hydraulic damping layer between its surface and that surface of the armature which faces toward said hydrodisc. Owing to the reduction of the downward overshoot, the time until the rest position is reached, that is to say until the injector is ready for another injection, can be shortened considerably. The thus reduced closing time of the injector is advantageous in particular in the case of multiple injection cycles, that is to say in the case of multiple fuel injections per working stroke.

The valve element may be a valve needle which is preferably in the form of a hollow needle. In this case, the hollow needle may have radial bores through which the medium or fuel passes into an interior space of the injector, such that the moving elements such as armature, valve element and the flange-like abutment element are lubricated by the medium or fuel.

FIG. 1 illustrates an exemplary injector according to the invention for injecting fuel into a combustion chamber of an internal combustion engine, which injector comprises an electromagnetic drive unit 2. The drive unit 2 has a magnet coil accommodated in a housing 1 and an armature 3 guided in sliding fashion in the housing 1. Furthermore, the injector comprises a valve needle 4 which is movable in the armature 3 axially with respect thereto and which has a driver 5 for coupling to the armature 3. The reference sign 8 designates a stopper plate which has been referred to above as abutment element or as flange-like abutment element and which is fixedly connected to the driver 5.

In the present case, the injector is shown in a rest position, that is to say the valve needle 4 is positioned in a valve seat such that an injection opening 6 is closed. In this case, the valve seat constitutes an abutment of the valve needle 4.

The injector furthermore comprises a spring 9 which is supported on the driver 5 and which counteracts the force during a reciprocating movement of the armature 3, of the valve needle 4 and of the stopper plate 8 during the opening of the injection opening 6. The force during the lifting movement is in this case dependent on a field strength of a magnetic field generated by means of the magnet coil. Furthermore, a second spring 10 is provided against which the armature 3 lies in the present rest state. With its opposite side, the spring 10 is supported on the housing 1.

In the exemplary embodiment illustrated, the stopper plate has been selected in terms of its dimensions such that its surface situated opposite an abutment surface 7 of a pole core 2' and its surface facing toward the armature 3 fully cover the respectively oppositely situated abutment and armature surfaces in terms of area. In an example that is not illustrated, said stopper plate may also be designed so as to be of smaller area, wherein it then engages into a depression in the armature surface, such that the circumferentially outer part of the armature surface is situated directly opposite the abutment surface.

The interior space of the injector is filled with a fuel which lubricates all of the moving elements, that is to say the springs 9 and 10, the valve needle 4, the armature 3 and the stopper plate 8 and the contact surfaces thereof with respect to the housing 1. Furthermore, the surfaces of the armature 3 and those of the stopper plate 8 are entirely wetted with the fuel. For the supply of fuel to the interior space, the valve needle 4 is in the form of a hollow needle, in the interior of which fuel is conveyed, which fuel passes via radial bores into the interior space of the injector.

The mode of operation of the injector according to the invention will be described in more detail below on the basis of FIGS. 2*a* to 2*c*.

Figures 2A, 2B, 2C:
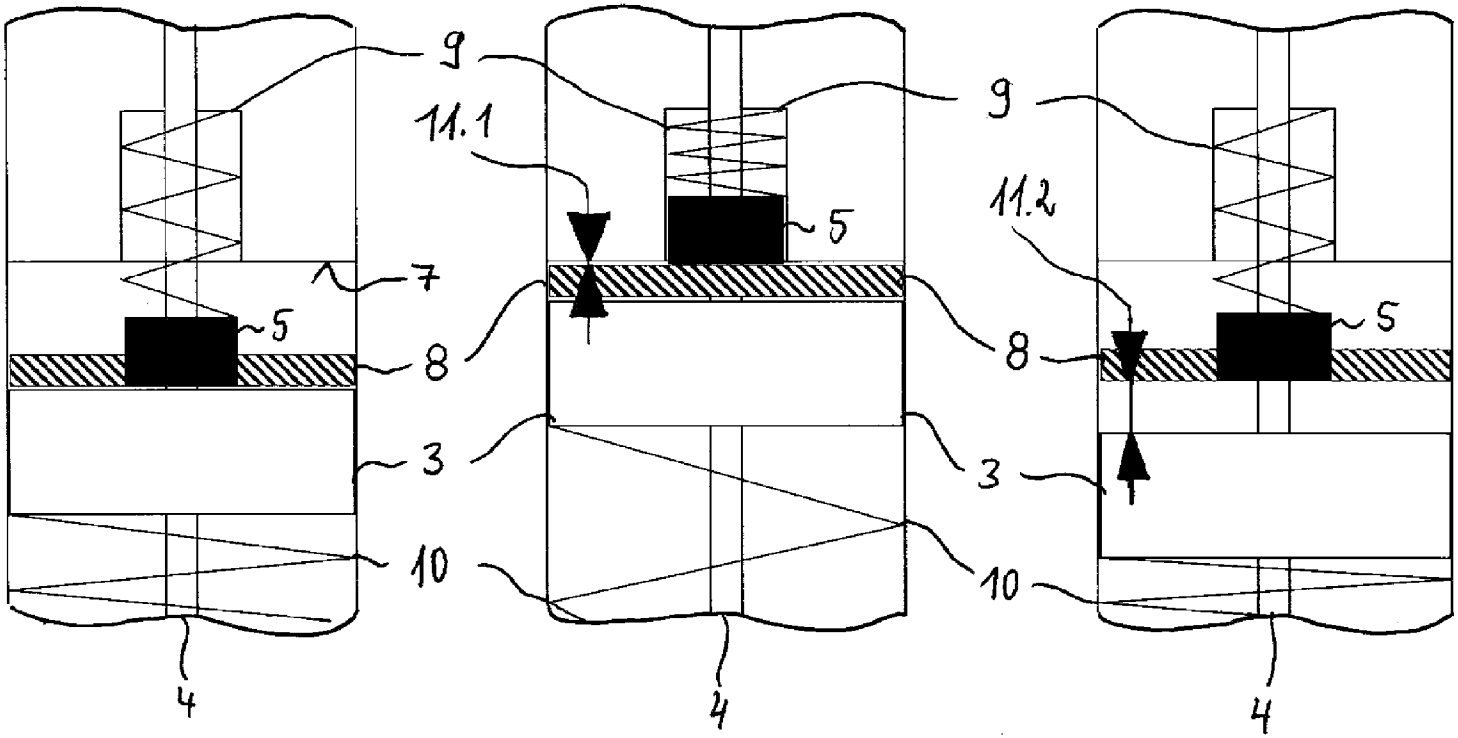
FIGS. 2*a*, 2*b* and 2*c* show an enlarged detail of the injector shown in FIG. 1 in three different positions.

FIG. 2*a* shows an enlarged detail of a sectional illustration of the injector in the rest position, that is to say the valve needle 4 is situated in the valve seat, wherein the injection opening 6 is closed, and the first spring 9 and the second spring 10 are in force equilibrium with respect to one another. An intermediate space provided between the abutment surface 7 and that surface of the stopper plate 8 which faces toward said abutment surface is filled with fuel.

To open the injector, the magnet coil has a voltage applied to it, by means of which a magnetic field is generated. Attracted by the magnetic field, the magnetic armature 3 performs the lifting movement and, in so doing, lifts the valve needle 4 and the stopper plate 8, owing to the coupling to the driver 5, out of the valve seat, wherein the injection opening 6 is opened. The stopper plate 8 is preferably also composed of a magnetic material, such that it assists the lifting movement of the armature 3. During the lifting movement, the stopper plate 8 displaces the fuel out of the intermediate space.

In this regard, FIG. 2*b* shows an enlarged detail of a sectional illustration of the injector in an open position, wherein the first spring 9 is stressed and the second spring 10 is relatively relaxed. Owing to the displacement of the fuel out of the intermediate space, the first hydraulic damping layer 11.1 is formed, the thickness of which decreases with the lifting movement in the direction of the abutment surface 7. Here, the first hydraulic damping layer 11.1 prevents contact between the stopper plate 8 and the abutment surface 7 of the pole core 2', and thus prevents bouncing or overshooting of the valve needle 4 during the opening of the injector.

To close the injector, the activation of the magnet coil is ended, that is to say the voltage supply is switched off. Here, the preloaded first spring 9 moves the armature 3, the driver 5 and the valve element 4 connected thereto and the stopper plate 8 into the rest position counter to the second spring 10.

FIG. 2*c* in turn illustrates an enlarged section of the injector during the closing process in a position in which the valve needle 4 is situated in its valve seat and the injection opening 6 has already been closed. In this case, the first spring 9 is relatively relaxed. As the valve needle 4 sets down on the valve seat, the armature 3 continues its movement further in the closing direction, that is to say it performs a downward overshoot movement, wherein it would be possible for the armature 3 to overshoot by for example 40 μm, and the second spring 10 is stressed further owing to the downward overshoot of the armature 3. The downward overshoot of the armature 3 causes an intermediate space to form between the stopper plate 8 and the surface of the armature 3, which intermediate space is filled with fuel. In this case, the armature 3, which moves in the direction of the rest position during the restoring movement of the second spring 10, displaces the fuel out of the intermediate space, wherein in turn, a second hydraulic damping layer 11.2 forms. At the end of the movement of the armature into the rest position, the second hydraulic damping layer 11.2 prevents contact between the stopper plate 8 and the armature 3. The second hydraulic damping layer 11.2 thus dampens the restoring movement of the armature 3, whereby closure bounce is prevented and the valve needle 4 is no longer lifted out of its valve seat.

What is claimed is:

1. An injector for injecting fuel into an internal combustion engine, comprising:

a drive unit accommodated in a housing and including:

an armature guided in the housing in a sliding manner, and a valve element axially movable relative to the armature, the valve element including a driver element that contacts the armature in certain states of the drive unit, wherein the valve element including the driver element is configured for an opening movement to open at least one injection opening and a closing movement to close the at least one injection opening, and a flange-like abutment element fixedly connected to the valve element, the flange-like abutment element configured such that, during an opening movement of the valve element a first hydraulic damping layer is formed between said abutment element and an abutment surface, and during a closing movement of the valve element a second hydraulic damping layer is formed between said abutment element and the armature.

2. The injector of claim 1, wherein the flange-like abutment element is connected to the driver element.

3. The injector of claim 2, wherein the flange-like abutment element has a surface which covers at least one of (a) at least a portion of the abutment surface and (b) at least a portion of a first surface of the armature.

4. The injector of claim 3, wherein the flange-like abutment element is formed from a magnetic material.

5. The injector of claim 4, wherein the drive unit comprises a solenoid drive.

6. The injector of claim 5, wherein the armature and the valve element are movable in a first direction counter to the force of at least one first spring and in a second direction counter to the force of at least one second spring.

7. The injector of claim 6, wherein the valve element is a valve needle.

8. The injector of claim 7, wherein the valve element is a hollow needle.

9. An internal combustion engine, comprising:

a plurality of fuel injectors, each comprising:

a drive unit accommodated in a housing and including:

an armature guided in the housing in a sliding manner, and a valve element axially movable relative to the armature, the valve element including a driver element that contacts the armature in certain states of the drive unit, wherein the valve element including the driver element is configured for an opening movement to open at least one injection opening and a closing movement to close the at least one injection opening, and a flange-like abutment element fixedly connected to the valve element, the flange-like abutment element configured such that, during an opening movement of the valve element a first hydraulic damping layer is formed between said abutment element and an abutment surface, and during a closing movement of the valve element a second hydraulic damping layer is formed between said abutment element and the armature.

10. The internal combustion engine of claim 9, wherein the flange-like abutment element is connected to the driver element.

11. The internal combustion engine of claim 10, wherein the flange-like abutment element has a surface which covers at least one of (a) at least a portion of the abutment surface and (b) at least a portion of a first surface of the armature.

12. The internal combustion engine of claim 11, wherein the flange-like abutment element is formed from a magnetic material.

13. The internal combustion engine of claim 12, wherein the drive unit comprises a solenoid drive.

14. The internal combustion engine of claim 13, wherein the armature and the valve element are movable in a first direction counter to the force of at least one first spring and in a second direction counter to the force of at least one second spring.

15. The internal combustion engine of claim 14, wherein the valve element is a valve needle.

16. The internal combustion engine of claim 15, wherein the valve element is a hollow needle.

* * * * *